United States Patent [19]

Eberhart

[11] Patent Number: 4,995,200

[45] Date of Patent: Feb. 26, 1991

[54] SANDING TOOL

[76] Inventor: Edward Eberhart, 116 S. Rogers, Northville, Mich. 48167

[21] Appl. No.: 485,971

[22] Filed: Feb. 27, 1990

[51] Int. Cl.[5] ..... B24D 15/00; B24D 17/00

[52] U.S. Cl. ..... 51/358; 51/372; 51/391

[58] Field of Search ..... 51/389-393, 51/149, 150, 148, 358, 372, 380, 381

[56] References Cited

U.S. PATENT DOCUMENTS

| | | | |
|---|---|---|---|
| 2,424,702 | 7/1947 | Miller | 51/390 |
| 2,447,327 | 8/1948 | Gerrits | 51/392 X |
| 2,871,630 | 2/1959 | Whitlock | 51/392 X |
| 3,871,141 | 3/1975 | Bonapace | 51/391 X |
| 4,694,618 | 9/1987 | Eberhart et al. | 51/392 |

*Primary Examiner*—Frederick R. Schmidt
*Assistant Examiner*—Bruce P. Watson
*Attorney, Agent, or Firm*—Barnes, Kisselle, Raisch, Choate, Whittemore & Hulbert

[57] ABSTRACT

An abrasive sanding tool which utilizes a sanding loop stretched over a tensioning body which has a narrow lateral reaction bar at one end of the loop and a cylindrical retainer at the other end of the loop. A handle screws onto the retainer and moves a shaft on the body within the hands to shift the lateral reaction bar into a position to tension the sanding loop.

3 Claims, 1 Drawing Sheet

SANDING TOOL

FIELD OF INVENTION

Hand tool for sanding wood and plastic with removable and replaceable belts.

BACKGROUND AND FEATURES OF THE INVENTION

The present invention is intended to be an improvement on a sanding tool previously patented by myself and Arlen Ingram in U.S. Pat. No. 4,694,618 dated Sept. 22, 1987. The Ingram device utilized a metal frame with a handle at one end and spaced parallel bars connected by a slightly resilient rod. A closed loop of abrasive material is suspended between the bars and tensioned by the connecting rod.

Other patents include Miller U.S. Pat. No. 2,424,702 (1947) on an abrasive strip holder, and Bonapace U.S. Pat No. 3,871,141 (1975) on a knife sharpener. Miller shows a tapered belt looped over at one end on a solid mandrel and carried at the other end on a lateral peg on a handle body element. Bonapace shows a knife sharpener with a tensioning head backed by a coil spring.

The present invention has as an object the provision of a sanding tool with three elemental parts using a flat closed loop which can be tensioned by a threaded adjustment and which is so designed that it can be inserted to narrow crevices with no interference from the supporting frame. The supporting structure provides a double faced sanding tool which increases from a vary narrow distal end to a wide proximal end so it can be utilized on one or both sides in closely spaced parts.

In brief, the object of the invention is achieved by three main parts. A first basic body part has at a distal end a narrow reaction cross-bar extending transversely of the axis of the body. The body has an elongate torque which tapers from a narrow dimension at the cross bar to a wider square or rectangular head end. Beyond the head end is a control shaft also on the axis of the body. A second element is a proximal sanding loop retainer having an opening to receive the control shaft and also a square or rectangular opening to receive the head end of the body. The second element has also a threaded extension boss element, internal or external, opposite the square opening to receive the third element. The third element is a hollow handle and tension control device which receives the control shaft and has also a threaded element to cooperate with the threaded boss of the second element.

An abrasive band is formed as a loop with an aperture to receive the threaded boss as the parts are assembled. In assembly, the boss of the second element is located in the aperture at one end of the abrasive loop, the basic body is positioned with the cross bar at the other end of the loop and the control shaft is passed through the second element into the hollow handle. The threaded elements are engaged and the handle is screwed onto the retainer. This will tension the sanding loop. The limit of the tension can be controlled by the shaft abutting the end of the hollow passage.

Additional objects and features of the invention will be apparent in the following description and claims in which the principles of the invention are set forth together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as follows.

DETAILED DESCRIPTION OF THE DEVICE AND THE MANNER AND PROCESS OF USING IT

Figure 1:
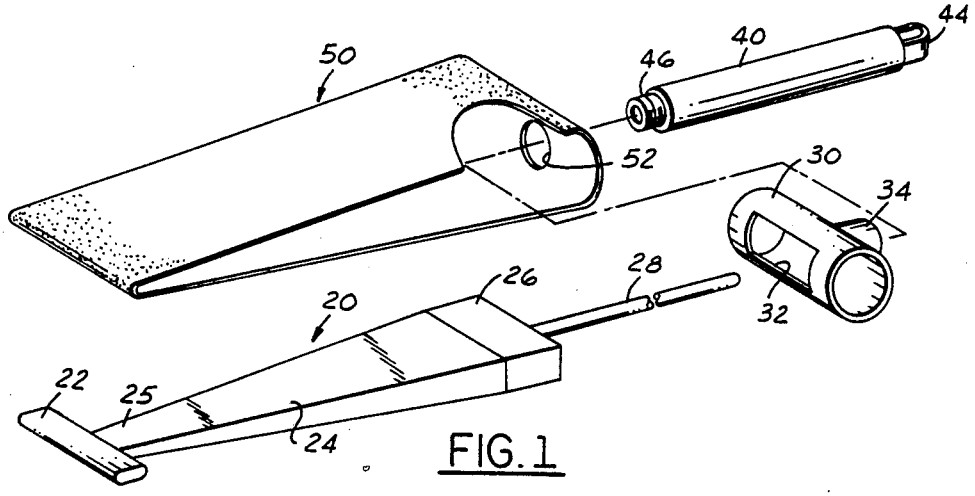
FIG. 1, a perspective view of the unassembled parts of the invention.

WITH REFERENCE TO THE DRAWINGS, in FIG. 1, a basic elongate body element 20 is illustrated with a relatively thin reaction cross bar 22 at the end of a tapered tongue member 24 which is relatively thin at 25 where it joins the cross bar 22. The body tongue element tapers in two dimensions to a head end 26 which is rectangular in cross-section. Extending from the head end 26 is a control shaft 28 coaxial with the general axis of the body 24.

A second element of the invention is a sanding loop retainer 30 which is essentially a hollow cylinder with a rectangular opening 32 and a boss extension 34 threaded internally on an axis coincident with the general axis of the body.

The third element of the invention is a control handle 40 which has a central bore 42 to receive the shaft 28. The bore 42 is closed at the proximal end at 45 but has a loop 44 to allow the tool to be suspended on a tool board. At the distal end of handle 40 is a threaded extension 46 which will thread into the internally threaded boss 34. This threaded relationship could be reversed by externally threading the boss 34 and internally threading the handle 40.

The sanding loop 50 is formed of a suitable flexible base of cloth or plastic with a granular exterior coating with such fineness or courseness as may be desired. A bight portion of the loop has a cut-out opening 52 to receive the boss 34 on retainer 30.

Figure 2:
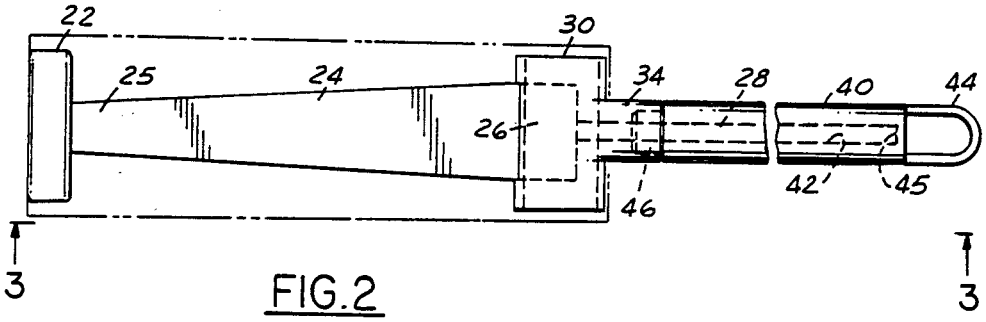
FIG. 2, a plan view of the assembled parts.
Figure 3:
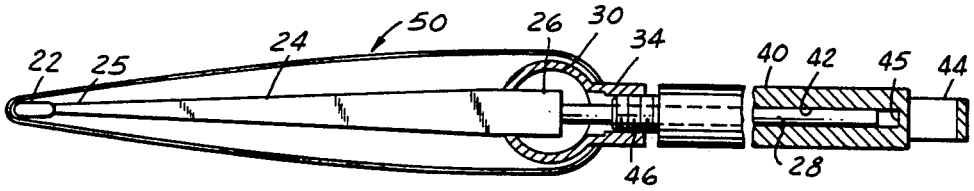
FIG. 3, a side view of the assembled parts prior to tensioning taken on line 3—3 of FIG. 2.
Figure 4:
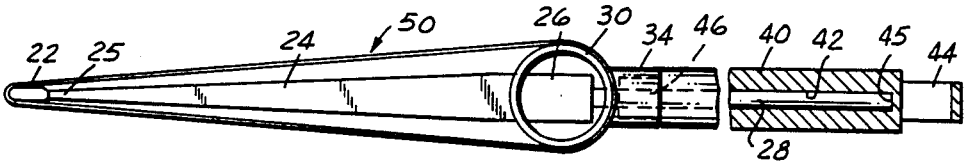
FIG. 4, a side view of the assembled parts with the sanding loop fully tensioned.

In assembly, the retainer element is first assembled in the apertured end of the loop 50 with the boss 34 projecting through the opening 52. The body element is then assembled by passing the shaft 28 through the openings 52 and 32 and through the boss 34. The transverse reaction bar 22 is then positioned in the distal end of the loop 50. Next the handle 40 is passed over the shaft 28 and threaded into the boss 34. At this stage, the part may appear as in FIG. 2 with the loop not drawn taut. By screwing the handle 40 further into the boss 34 tension is applied to the loop as the shaft 28 reaches the end 45 of the boss and endwise pressure on shaft 28 pushes the body 24 down to the distal end of cross bar 22 of the sanding loop.

The shape of the tongue body 24 and the cross bar 22 is significant in connection with the use of the sanding tool. The narrowed portion of the body adjacent the cross bar allows the loop to be recessed in toward the body so the loop can take a depressed curved position where it is desired to sand surfaces which are not flat. Pressure on the surfaces of the loop affords this flexibility without a grounding out of the sanding surface which might cause undue cutting on the surface being treated.

The location of the acircular rectangular head 26 in the recess 32 allows full control of the tool by the user holding the handle. The parts will not twist relative to each other when pressure is applied to one side or the other of the loop. The shape of the retainer element 30 is such that the head end of the tongue element has a sliding relationship in the recess 32 to allow for axial tensioning motion.

It will be seen that it would be simple matter to remove and replace sanding loops to change the grade of fineness or to replace when worn.

What is claimed is:

1. A sanding tool which utilizes a closed flexible loop of material with an abrasive surface which comprises:

(a) an elongate body support member having a generally first axis with a relatively thin loop, transverse reaction bar at one end lying transversely of the first axis and to lie within and to support a distal end of a closed abrasive loop, and an elongate, flat tongue member extending from said reaction bar to a proximal head end and tapering in two dimensions from a narrow dimension smaller than the reaction bar to a wider dimension at the proximal head end, (b) a control shaft on said first axis extending from said head end of said tongue, (c) a retainer and tensioning element at said head end having a recess on said axis to receive an acircular portion of said head end of said tongue member in a sliding relationship and having a proximal surface to support a proximal end of an abrasive loop, said retainer having a threaded boss extending away from said proximal surface, and (d) a hollow handle on said first axis having an axial bore and having a threaded portion to cooperated with said boss, and means at the proximal end of said bore to contact the end of said control shaft to move said shaft and tongue and transverse reaction bar toward the distal end of an abrasive loop to tension the loop between said reaction bar and said retainer element as said threaded portion on said handle is moved relative to the threaded boss.

2. A sanding tool as defined in claim 1 in which said retainer element comprises a cylindrical piece having one side with the acircular recess diametrically opposed to said boss to receive the acircular portion of said tongue member and the other side around said boss curved to support the proximal end of said loop.

3. A sanding tool as defined in claim 1 in which said retainer element comprises an open-ended hollow cylindrical piece having one side between the open ends provided with the acircular recess concentric with said axis diametrically opposed to said boss to receive the acircular portion of said tongue member.

* * * * *